US005890495A

United States Patent [19]

Cain

[11] Patent Number: 5,890,495

[45] Date of Patent: Apr. 6, 1999

[54] STENCILED DISPOSABLE GLOVE AND METHOD FOR POLISHING AND FILING NAILS

[76] Inventor: Alicia R. Felder Cain, 94-21 239th St., Floral Park, N.Y. 11001

[21] Appl. No.: 26,398

[22] Filed: Feb. 19, 1998

[51] Int. Cl.[6] ..... A45D 29/00; A45D 40/30; A41D 19/00

[52] U.S. Cl. ..... 132/73; 2/285; 2/319; 2/159; 2/160

[58] Field of Search ..... 132/73.5, 73, 285, 132/319; 2/159, 160, 163, 169; 434/100

[56] References Cited

U.S. PATENT DOCUMENTS

| | | | |
|---|---|---|---|
| 2,094,962 | 10/1937 | Raworth | 132/73 |
| 2,234,657 | 3/1941 | Smaldone | 132/73 |
| 2,262,977 | 11/1941 | Vasil | 132/88.5 |
| 2,283,703 | 5/1942 | Stedman | 132/88.5 |
| 3,245,418 | 4/1966 | Dinerstein | 132/88.5 |
| 5,277,205 | 1/1994 | Jenkins | 132/200 |
| 5,427,121 | 6/1995 | Polito | 132/20 |
| 5,645,090 | 7/1997 | Juhl et al. | 132/285 |

FOREIGN PATENT DOCUMENTS

| | | | |
|---|---|---|---|
| 2241272 | 3/1975 | France | 132/73 |
| 2606611 | 5/1988 | France . | |
| 2308501 | 8/1974 | Germany . | |
| 3347437 | 7/1985 | Germany . | |
| 3347437 | 11/1985 | Germany | 132/73 |

*Primary Examiner*—John J. Wilson
*Assistant Examiner*—Trang Doan
*Attorney, Agent, or Firm*—Richard C. Litman

[57] ABSTRACT

Method and stenciled glove for applying designs to fingernails or toenails. The stenciled glove includes digits having tips with ornamental cutout shapes and filing cutout patterns. An inner adhesive dot is provided proximate each cutout shape for stabilizing the glove tips over the nails. Nail polish is applied to the tips of the stenciled glove to form designs on the nails which can also be filed into decorative patterns.

20 Claims, 2 Drawing Sheets

STENCILED DISPOSABLE GLOVE AND METHOD FOR POLISHING AND FILING NAILS

BACKGROUND OF THE INVENTION

1. Field of the Invention

The present invention relates generally to a disposable integral stenciled glove. More particularly, the disposable stenciled glove is for the application of designs on fingernails, false fingernails or toenails by either professional manicurists or any woman desiring to decorate or file her nails.

2. Description of the Related Art

The related art of interest describes various stenciling devices and methods, -but which omit the integration of a glove with a stencil which is cut out in the glove for polishing and filing fingernails and toenails. The related art will be discussed in the order of its perceived relevance to the present invention.

U.S. Pat. No. 2,283,703 issued on May 19, 1942, to Norma Stedman describes a rubber fingernail stencil which has a cutout for a fingernail. The opening has raised edge elements to define the edges of the fingernail. The front edge of the cutout fit underneath the front portion of the fingernail. The rear edge of the rubber fingernail stencil is rolled over. One fingernail stencil is preferably used for ten fingers, but a plurality of stencils or caps for all the fingers may be utilized. It is suggested as an incidental description that a set of caps may be attached as the ends of the fingers in a glove, but a glove is not claimed. Moreover, if a close fitting surgical type is utilized, the glove would be difficult to place on a hand or foot and the cutout design would become distorted. Stedman further recites "Where the material of the cap in general is not elastic, a piece of elastic material may be attached at one end to one side of the opening and at the other end to the other side of the opening and may be long enough to be drawn tightly under the finger" (page 2, column 1, lines 22–27). This disclosure teaches against the use of an elastic glove with a cutout stencil integrated at its tips as in the present invention.

U.S. Pat. No. 5,427,121 issued on Jun. 27, 1995, to Joyce H. Polito describes a spray on nail polishing method utilizing an adhesive backed finger shield of foil paper with an oblong cutout for each fingernail or toenail and spraying three coats starting with a base coat paint through the finger shield, an acrylic paint spray through a stencil with an adhesive back, and a top coat paint after removal of the stencil. Oval stencils may have designs such as hearts, stripes, dots, and a leaf. The three-coat method and the use of shields and stencils are distinguishable from the one unit stenciled glove of the present invention.

German Patent Application No. 3,347,437 published on Jul. 11, 1985, for Josef Kroesen describes a similar method involving the use of brushed polish and thin stencil foils applied to the fingernail. FIG. 9 illustrates 9 designs for the stencils. The method is distinguishable for using stencils adhered to the fingernails.

U.S. Pat. No. 2,094,962 issued on Oct. 5, 1937, to Roberta G. Haworth describes a manicuring device for shielding the lunule of a fingernail during the application of nail polish. Two different wrap around strips of thin rubber with either variable sized circular portions or a single indentation and a tongue and hole binding means are shown. A third embodiment utilizes a tube with a lunule mask. Other materials such as cellophane and celluloid are applicable as manicuring devices. The devices are distinguishable for being open-ended and applied only on the fingertips.

U.S. Pat. No. 2,234,657 issued on Mar. 11, 1941, to Frank M. Smaldone describes a nail decorating method and device utilizing an adhesive backed crescent shaped paper sheet to cover the lunule of a fingernail and a stencil with a star cutout. The lunule masks may be packaged on a card. The method and device are distinguishable as being limited to fingertip masking.

U.S. Pat. No. 3,245,418 issued on Apr. 12, 1966, to Ben Dinerstein describes a shielding device for applying nail-hardening formaldehyde compositions to fingernails. A triangular stencil with adhesive backing and a removable protective covering on top has a forwardly arched curvilinear slit forming a flap and either a slit or a curved aperture behind the flap. The shielding device is placed over a fingertip with the flap projecting and the front tip adhered under the fingertip. The device is distinguishable for its limitation only to a fingertip.

U.S. Pat. No. 5,645,090 issued on Jul. 8, 1997, to Kathryn A. Juhl et al. describes a French manicuring device kit and a method of applying polish to a fingernail tip. The stencil is a flexible oval piece of plastic with two curved slots defining a bottom strap for holding the stencil to a fingertip. The nail polish is added only to the exposed tip of the fingernail to create the French manicure design. The device is distinguishable for its limitation to a fingertip and for creating only one design.

French Patent Application No. 2,606,611 published on May 20, 1988, for Roland Gobert describes a method for applying false fingernails using a mask. The mask is distinguishable from the present invention for not having any design cutouts.

German Patent Application No. 2,308,501 published on Aug. 22, 1974, for Daniel J. Petermann describes a stencil card including cutouts for all four fingernails and the thumbnail in a first embodiment. A second embodiment employs flower designs for the fingernails with a slot for engaging the tip of the fingernail. Therefore, the card devices are distinguishable in lacking the glove attachment of the present invention.

U.S. Pat. No. 5,277,205 issued on Jan. 11, 1994, to Nevia Jenkins describes a method and apparatus for applying decoration to fingernails or toenails. A jig surrounds a fingertip and a connected well on top feeds fingernail polish below it to a removable stencil with an animal design. The device and method are distinguishable for the use of a jig.

U.S. Pat. No. 2,262,977 issued on Nov. 18, 1941, to Nick Vasil describes a fingertip clamping device having two or more removable fingernail stencils. The device is distinguishable from the present invention which does not require clamps.

None of the above inventions and patents, taken either singularly or in combination, is seen to describe the instant invention as claimed. Thus a stenciled disposable glove for polishing nails solving the aforementioned problems is desired.

SUMMARY OF THE INVENTION

The present invention provides a disposable stenciled glove useful for the application of designs on fingernails, false fingernails or toenails by either professional manicurists or any woman desiring to decorate her fingernails or toenails herself by applying nail polish and/or filing the tips of the nails to form aesthetically pleasing designs.

Accordingly, it is a principal object of the invention to provide an integral stenciled manicuring glove for polishing and/or filing real and false nails.

It is another object of the invention to provide an integral stenciled manicuring glove for polishing and/or filing fingernails and/or toenails.

It is a further object of the invention to provide an integral stenciled manicuring glove having a design for nail tip filing along with the ornamental designs for the nails.

Still another object of the invention is to provide an integral stenciled manicuring glove having an adhesive dot placed within the glove adjacent to the ornamental design.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
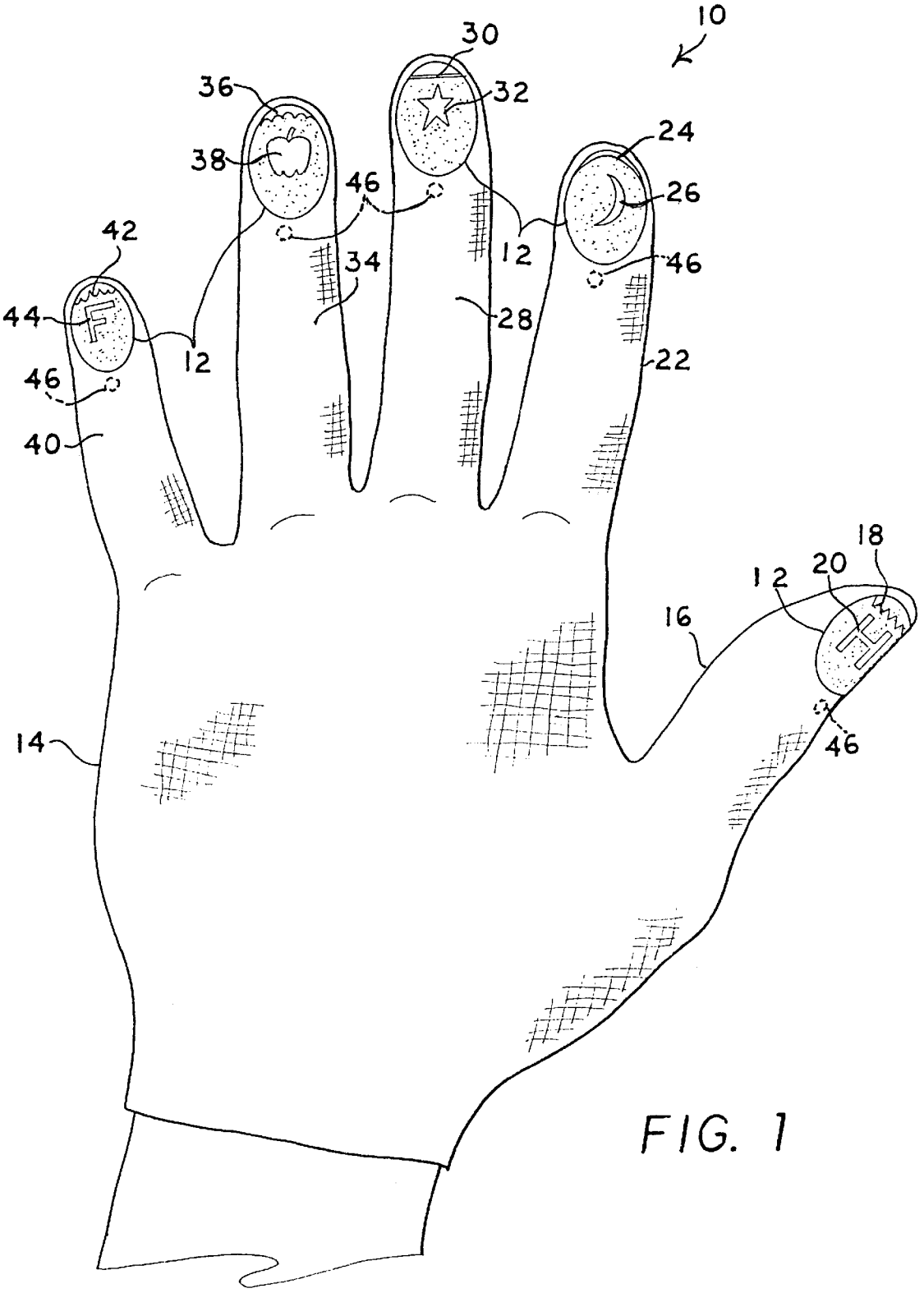
FIG. 1 is an environmental plan view of a stenciled disposable glove on a hand for polishing and filing fingernails according to the present invention.

The present invention directed to a transparent fingernail manicuring hand glove 10 is illustrated in FIG. 1 as having various ornamental designs cut in the oval stenciled regions 12. Each stenciled region 12 has in addition another filing indicia cutout. The oval stenciled region 12 can be reinforced in the left hand 14. Starting with the thumb 16, a sharp toothed filing pattern (cut out) 18 for subsequent filing of the thumbnail tip is provided above an initial "H" 20 which could stand for the person's first name. The index finger 22 has an arcuate filing cutout pattern 24 above the ornamental crescent moon design 26. The middle finger 28 has a straight line filing cutout pattern 30 above the star design 32. The next finger 34 has a scalloped edge filing cutout pattern 36 above a fruit design such as an apple 38. The little finger 40 has a wavy filing cutout pattern 42 above the initial "F" 44 which could stand for the person's last name.

Each digit has an adhesive spot 46 proximate the oval stencil 12 and placed underneath on an inside surface of the hand glove 10 for the purpose of maintaining the oval stencils 12 on the digit. Yet, the adhesive dot 46 must not be overly tenacious for preventing the insertion and removal of the hand glove 10.

It should be understood that the filing cutout patterns and the ornamental designs are exemplary and are not all present on one glove 10. The oval configuration of the stencil 12 is exemplary and other shapes such as square or circular are contemplated. Furthermore, the use of the filing patterns is optional. When the filing patterns are utilized by polishing and/or spraying, the gloves are removed and the tips of the nails are filed according to the pattern. If the user wishes, the filing patterns can be left on as part of the ornamental design. A French manicure pattern (not shown) can be included at the tip for applying a white tip. It is within the ambit of the present invention to superimpose one pattern on another by utilizing a second glove 10.

The gloves 10 are preferably made of transparent plastic which are relatively inelastic compared to a close fitting surgeon's operating glove made of latex rubber. It is a requirement of the glove 10 to fit a user's hand readily without undue stretching and be readily removable after polishing. The plastic glove must have the property of not absorbing or reacting with the ketone containing nail polish composition being applied. The glove 10 is preferably packaged within an envelope (not shown) for ready use. The glove 10 can be supplied in several sizes such as small, medium and large. An important consideration is that these transparent plastic gloves are disposable.

Figure 2:
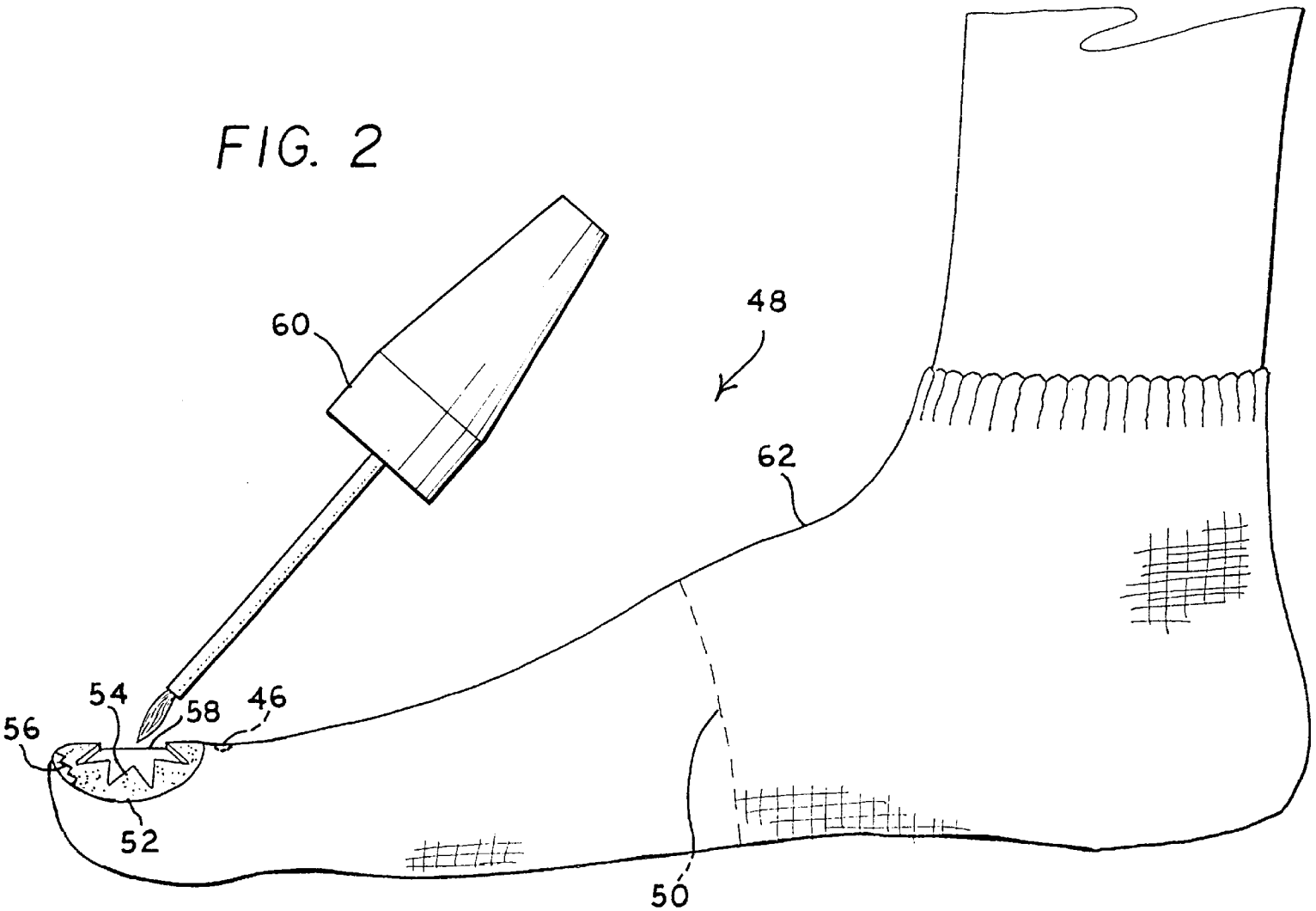
FIG. 2 is a side view of a stenciled disposable glove on a foot for polishing and filing toenails according to the present invention.

FIG. 2 depicts as a second embodiment a foot glove 48 on a foot 62. An abbreviated foot glove 50 (dashed line) is also contemplated. The circular stencil 52 has an ornamental star 54 with multiple points. A serrated filing pattern 56 is shown for filing the toenails 58. A polish applicator 60 is illustrated for applying the polish. The adhesive dot 46 of the foot glove 48 is shown in shadow for ensuring the stability of the circular stencil 52 over the toenail 58.

It is to be understood that the present invention is not limited to the embodiments described above, but encompasses any and all embodiments within the scope of the following claims.

I claim:

1. A stenciled disposable glove for polishing and filing nails comprising:

a flexible transparent plastic glove having digits selected from the group consisting of fingers and toes;

said digits having tips with integral cutout stencils for overlying nails;

said cutout stencils having a shape selected from the group consisting of oval, square and circular;

each said stencil having a cutout pattern for filing an edge of a nail and an ornamental cutout design; and an adhesive spot located on an inside surface of said glove proximate to each said stencil;

whereby a person can apply nail polish to mark a filing pattern of an edge of each nail and form a design from said ornamental cutout design with a minimum of movement of said glove over each said digit by the adherence of said adhesive spot of said glove to each said digit.

2. The stenciled disposable glove according to claim 1, wherein said digits are fingers.

3. The stenciled disposable glove according to claim 1, wherein said digits are toes of a foot glove extending to an ankle.

4. The stenciled disposable glove according to claim 1, wherein said digits are toes of a glove for part of a foot.

5. The stenciled disposable glove according to claim 1, wherein said stencils have an oval shape.

6. The stenciled disposable glove according to claim 1, wherein said stencils have a square shape.

7. The stenciled disposable glove according to claim 1, wherein said stencils have a circular shape.

8. The stenciled disposable glove according to claim 1, wherein said cutout pattern for filing an edge of a nail has a shape selected from the group consisting of a sharp toothed shape, a curved shape, a straight line, a scalloped shape, and a wavy shape.

9. The stenciled disposable glove according to claim 8, wherein said filing pattern shape is sharp toothed.

10. The stenciled disposable glove according to claim 8, wherein said filing pattern shape is curved.

11. The stenciled disposable glove according to claim 8, wherein said filing pattern shape is a straight line shape.

12. The stenciled disposable glove according to claim 8, wherein said filing pattern shape is scalloped.

13. The stenciled disposable glove according to claim 8, wherein said filing pattern shape is wavy.

14. The stenciled disposable glove according to claim 1, wherein said ornamental cutout design is selected from the group consisting of an alphabetical letter, a crescent moon, a star, a fruit, and a wave.

15. The stenciled disposable glove according to claim 14, wherein said ornamental cutout design is an alphabetical letter.

16. The stenciled disposable glove according to claim 14, wherein said ornamental cutout design is a crescent moon.

17. The stenciled disposable glove according to claim 14, wherein said ornamental cutout design is a star.

18. The stenciled disposable glove according to claim 14, wherein said ornamental cutout design is a wave.

19. A process of polishing and filing nails comprising:

selecting a flexible transparent plastic glove having digits selected from the group consisting of fingers and toes;

the digits having tips with integral cutout stencils for overlying nails of a user, the cutout stencils having a shape selected from the group consisting of oval, square and circular;

inserting a user's digits into the glove and positioning the integral cutout stencils over each nail;

pressing down on each cutout stencil to secure its position by an adhesive dot applied proximate to and underneath each cutout stencil;

applying a nail polish composition on each stencil having a cutout pattern for filing an edge of a nail and an ornamental cutout design for a nail;

removing the stenciled glove from the user's digits; and filing the nails according to the pattern formed on the nails;

whereby the digits have nails with a filed edge pattern and an ornamental design.

20. The process according to claim 19, wherein the digits are fingers.

* * * * *